United States Patent [19]

Smith

[11] Patent Number: 4,951,380

[45] Date of Patent: Aug. 28, 1990

[54] WAVEGUIDE STRUCTURES AND METHODS OF MANUFACTURE FOR TRAVELING WAVE TUBES

[75] Inventor: Burton H. Smith, Lexington, Mass.

[73] Assignee: Raytheon Company, Lexington, Mass.

[21] Appl. No.: 201,730

[22] Filed: Jun. 30, 1988

[51] Int. Cl.[5] ..... H01J 9/00

[52] U.S. Cl. ..... 29/600; 315/3.5; 333/141

[58] Field of Search ..... 333/141, 145, 147, 156, 333/157; 29/600; 315/3.5

[56] References Cited

U.S. PATENT DOCUMENTS

| | | | |
|---|---|---|---|
| 1,678,116 | 7/1928 | Harrison | 333/141 X |
| 1,788,519 | 1/1931 | Harrison | 333/145 |
| 2,761,828 | 9/1956 | Eldredge et al. | 333/157 X |
| 2,800,604 | 7/1957 | Beaver | 333/157 X |
| 2,924,738 | 2/1960 | Chodorow | 333/156 X |
| 3,099,765 | 7/1963 | Meyerer | 333/157 X |
| 3,099,767 | 7/1963 | Gross | 333/157 X |
| 3,543,194 | 11/1970 | Kassabgi | 333/156 |
| 3,621,462 | 11/1971 | Hammer et al. | 333/156 X |
| 3,633,133 | 1/1972 | Bise | 333/141 X |
| 3,876,902 | 4/1975 | Gross | 333/156 X |
| 4,765,056 | 8/1988 | Harper et al. | 29/600 |
| 4,807,355 | 2/1989 | Harper | 29/600 |

FOREIGN PATENT DOCUMENTS

| | | | |
|---|---|---|---|
| 0080156 | 11/1955 | Denmark | 333/156 |
| 1233713 | 10/1960 | France | 333/157 |

*Primary Examiner*—Thomas H. Tarcza
*Assistant Examiner*—Bernarr Earl Gregory
*Attorney, Agent, or Firm*—Denis G. Maloney; Richard M. Sharkansky

[57] ABSTRACT

Slow-wave structures are formed by the method of this invention in the form of a coupled-cavity structure. The coupled-cavity form of waveguide slow-wave structures is formed by wire electric discharge machining of disks from a solid rod of copper. The disks are supported in their desired positions by retained portions of the rod while the disks are brazed inside a cylindrical shell of copper. After brazing, the retained portions may be partially removed to form the completed slow-wave structure.

20 Claims, 4 Drawing Sheets

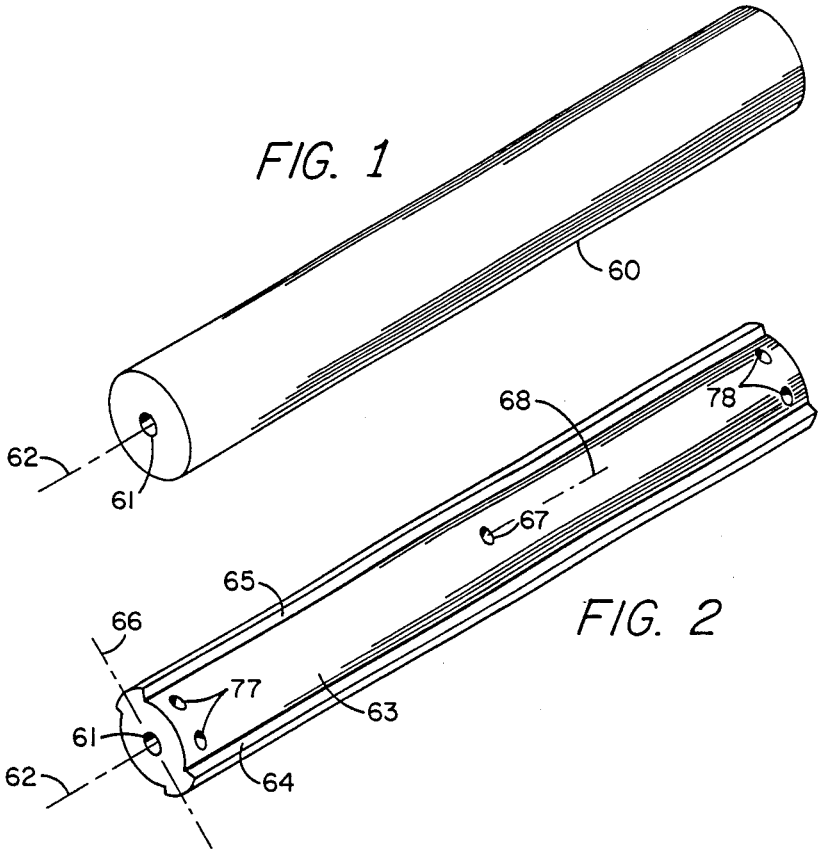
FIG. 1
FIG. 2
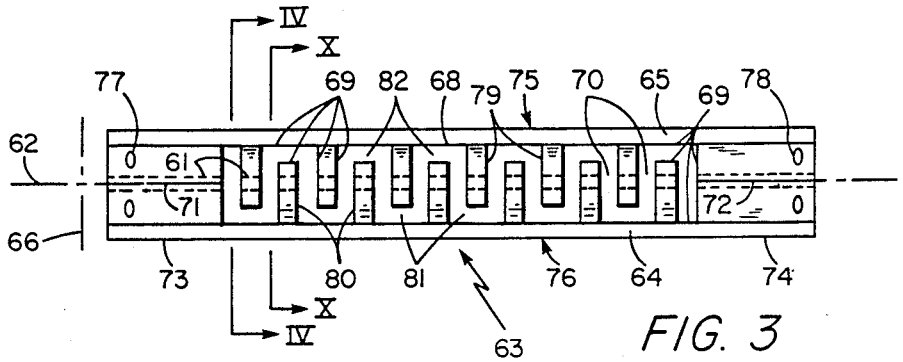
FIG. 3
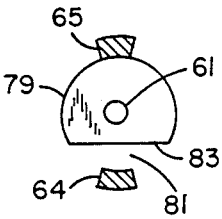
FIG. 4
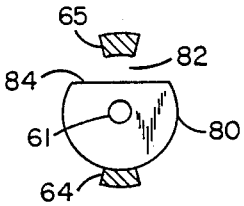
FIG. 5
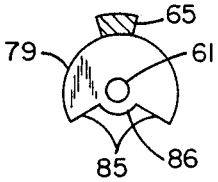
FIG. 6
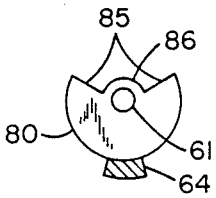
FIG. 7

WAVEGUIDE STRUCTURES AND METHODS OF MANUFACTURE FOR TRAVELING WAVE TUBES

BACKGROUND OF THE INVENTION

This invention relates to traveling wave tubes and more particularly to the method of manufacture of the slow-wave structure of a traveling wave tube which couples the incoming microwave energy at several tens of gigahertz frequency to the electron beam of the traveling wave tube in order to thereby amplify the incoming microwave energy and to provide the amplified microwave energy at the other end of the slow-wave structure.

This invention more specifically relates to multi-axis wire electric discharge machining methods for fabricating slow-wave structures, and in particular, a coupled cavity slow-wave structure for traveling wave tubes.

The conventional manner of constructing the coupled cavity slow-wave structure or delay line for the traveling wave tube is to fabricate the assembly from individually machined disks which can number in excess of one-hundred which must be brazed to a support structure to produce the delay line. Each disk has a portion of its periphery removed so that the cavities formed by the stack of laminations so that the cavity formed by an adjacent disks are coupled to adjacent cavities. The prior art technique of forming such an assembly results in a total parts cost which is very high together with problems in obtaining good control of dimensional tolerances - particularly, the pitch (the separation of the adjacent disks) which can have cumulative errors. The cost of making a delay line by the method of the prior art is substantial.

SUMMARY OF THE INVENTION

It is therefore a primary object of this invention to provide a less expensive method for fabricating slow-wave structures for use in a traveling wave tube.

Another object of this invention is to provide a more precise delay line for use in a traveling wave tube over that previously available.

The foregoing and other objects of this invention are attained by forming a slow-wave structure, a coupled cavity delay line in this preferred embodiment, from a solid cylinder of high electrical conductivity material by essentially only wire electric discharge machining operations. Brazing operations to form the completed delay line are limited to joining to the interior of a cylindrical shell to the peripheral portions of disks supported to form semi-cylinders as produced by the electric discharge machining operations.

The waveguide slow-wave structures are formed by multi-axis wire electric discharge machining of disks from a solid rod of copper. Pilot holes are conventionally drilled into the copper rod and threaded with the wire for machining. The wire is generally oriented successively in at least three orthogonal directions for machining of the complex slow-wave structure suitable for use in traveling wave tubes. The disks of the coupled-cavity form of slow-wave structure are supported in their desired positions by portions of the rod which are retained while machining and the disks are brazed inside a cylindrical shell of copper. After brazing, the supporting retained portions of the rod may be removed in whole or part to form the completed slow-wave structure.

This invention has the advantage that the method for fabricating by multi-axis wire electric discharge machining (EDM) of slow-wave circuits such as a coupled cavity traveling wave tube slow-wave circuit result in reduced costs of parts, better control of pitch (especially cumulative errors), better beam hole alignment, and lower final assembly labor costs.

The differences between the method of this invention over that which has been used previously for delay line fabrication is that this method can provide complex delay line features by using wire EDM cutting along numerous axes. This makes possible fabrication of many different delay line embodiments. In some embodiments, the delay line core can be fabricated in one piece with no braze joints required except to the outer shell. This method also makes possible the machining of ferrules at the interaction gaps. This has not been feasible with previous methods. In the prior art, wire EDM has been used to cut a planar folded waveguide circuit, cut its tunnel, and trim its outer surface but multi-axis machining has not been recognized as a means for making complex structures such as that of this invention.

BRIEF DESCRIPTION OF THE DRAWINGS

The aforementioned aspects and other features of the present invention will be apparent from the following description taken in conjunction with the accompanying drawings wherein:

FIG. 1 is an isometric view of a cylindrical bar having an axial beam tunnel hole;

FIG. 2 is an isometric view of the bar of FIG. 1 after further machining;

FIG. 3 is a side view of the bar of FIG. 2 after machining to produce disks of a slow-wave structure;

FIGS. 4–7 show plan views of the disks of FIG. 3;

DESCRIPTION OF THE PREFERRED EMBODIMENT

Figure 8:
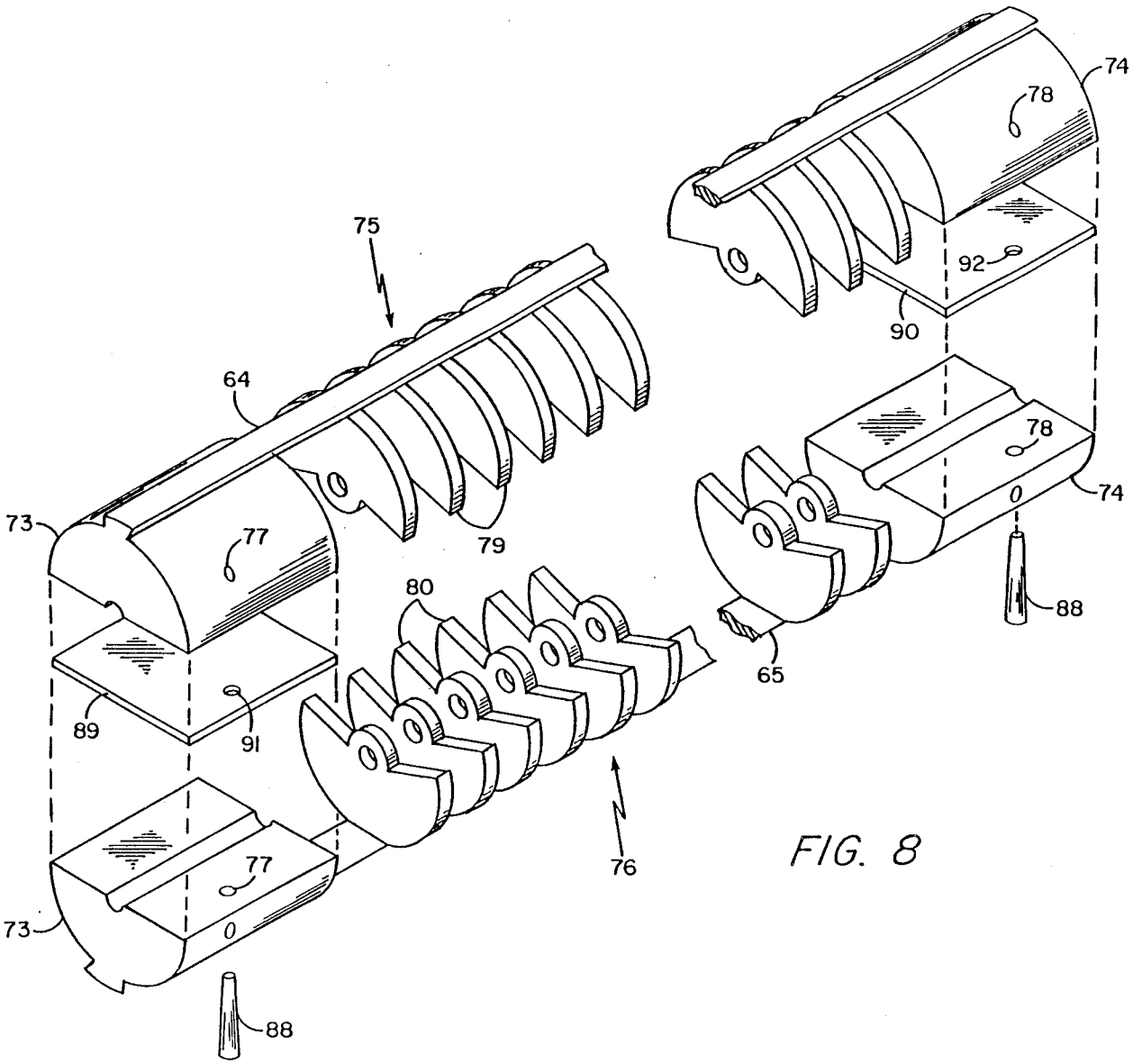
FIG. 8 is an isometric exploded view of the structure of FIG. 3 as modified in FIGS. 6 and 7.

Fabrication of the slot-coupled cavity delay line of this invention is begun with a solid cylindrical bar of copper shown in FIG. 1 through which an axially-extending electron beam tunnel or hole 61 centered on the axis 62 of the cylinder 60. The hole 61 is produced by electric discharge machining. Typically, a drilled hole smaller in diameter than tunnel 61 is first drilled by conventional techniques. An electric discharge wire is threaded axially through the drilled hole and held taut at each end of cylinder 60. The wire is attached to a source for electric discharge machining and is moved about axis 62 in a circular path to produce the axially aligned tunnel 61 of uniform, smooth, controlled diameter. Typically, for a TWT design in the 40 GHz range, the length of the bar 60 would be 3 inches with a diameter of $\frac{5}{8}$ inch. The beam tunnel 61 is typically 0.040 inch in diameter. The cylinder 60 after the tunneling operation is shown in FIG. 1.

The next step in the method is to machine the cylinder 60 to provide a smaller cylindrical body 63 of circular cross-section transverse to the axis 62 while retaining diametrically opposite rails 64, 65 which connects alternate cavity walls and establishes delay line pitch. Electric discharge machining with the erosion wire parallel to axis 62 can be used to provide the resulting structure shown in FIG. 2. The surface of cylinder 63, excepting beam tunnel 11, is gold plated with gold 59 in preparation for a subsequent brazing operation.

The next step in the fabrication of the cylinder 63 is electric discharge machining to produce a cut 69 through the cylinder 63 in a direction transverse to the plane which extends along and through the axis 62 and which extends through the line 66 which bisects the rails 64, 65. A hole 67 is initially conventionally drilled in this transverse direction through the cylinder 63 to allow the cutting wire 68 used in the electric discharge machining to be threaded through cylinder 63. The wire 68 is held transversely to the plane of axis 62 and line 66. The serpentine cut line 69 shown in FIG. 3 shows the path followed by the threaded cutting wire 68 in cutting out from the cylinder 63 the copper interdisk material 70 which is removed after the cut 69 has been completed to thereby provide disks 79, 80. A plan view of cylinder 63 after the cut 69 is made is shown in FIG. 3. Cross-sectional views of cylinder 63 of FIG. 3 taken along section line IV—IV and along section line V—V are shown in FIGS. 4, 5, respectively, show disks 79, 80 formed by the cut 69. The disks 79, 80 formed by cut 69 alternate and are attached to the rails 65, 64, respectively. The disks 79, 80 are spaced from the rails 64, 65, respectively, by the slots 81, 82, respectively, formed by cut 69.

Tapered alignment holes 77, 78 are machined through the ends 73, 74, respectively, of cylinder 63 for use in an assembly step to be described later. The axes of holes 77, 78 are preferably transverse to the cut lines 71, 72. Cuts 71, 72 along the axis 62 are transverse to the plane of axis 62 and line 66 of FIG. 2 at the ends 73, 74, respectively, of the bar 63. The cuts 71, 72 allow cylinder 63 upper portion 75 to be separated from its lower portion 76. After separation of upper and lower portions 75, 76, the disks 79, 80 are electric discharge machined to cause their flat faces 83, 84, respectively, of FIGS. 4, 5 to be modified as shown in FIGS. 6, 7 to increase the electromagnetic coupling of the cavities 70 of FIG. 3 formed by adjacent disks 79, 80. The wire used in this electric discharge machining process is oriented parallel to the axis 62 and extends over the length of the rails 64, 65 between the ends 73, 74. The wire is moved radially to form the surfaces 85 of FIGS. 6, 7 which in a preferred embodiment are at an angle of substantially 67° with respect to a plane through the axis 62 and the center line 66 of the rails 64, 65. The wire discharge process also is used with the immediately preceding orientation to provide a cylindrical surface 86 on disks 79, 80. The surface 86 has a radius typically 0.03 inches centered on the axis 62, and is only slightly greater than the radius of hole 61.

An exploded isometric view of the upper and lower portions 75, 76 after these machining operations is shown in FIG. 8. FIG. 8 shows the bisected ends 73, 74 with each bisected end containing a portion of tapered alignment holes 77, 78, respectively. Holes 77, 78 were machined into the cylinder 63 of FIG. 2 prior to the ends 73, 74 shown in FIG. 3 being cut longitudinally along the axis 62 to provide the half-cylinder portions 75, 76 shown in FIG. 8. Since the wire electric discharge machining process producing the cuts 71, 72 erodes a portion, typically .01 inches, of split ends 73, 74 during the splitting process, it is desirable to insert a shim 89 of equal thickness to the portion lost by erosion between the split ends 73, 74 of FIG. 8 before subsequent assembly in order to preserve the alignment of the halves of tunnel hole 62 and the circularity of the circumference of the assembled disks 79, 80 for a subsequent brazing step.

Figure 9:
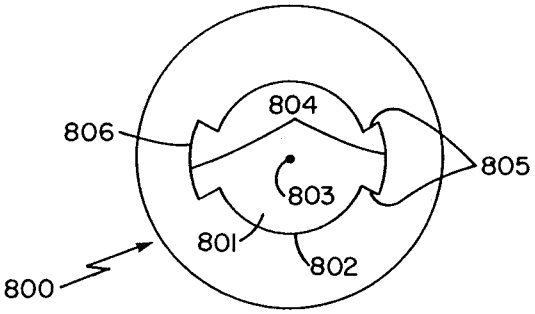
FIG. 9 is an end view of the shell portion of the slow-wave structure.

The cylindrical shell 800 shown in end view in FIG. 9 is next fabricated by electric discharge machining by a wire parallel to axis 803 a block of oxygen-free, high conductivity copper to provide the shell 800 which has a hole 801 having a cylindrical surface 802 of the same diameter as that of disks 79, 80 and which is concentric with the central axis 803 of shell 800. The surface 802 is provided with longitudinal grooves 804. Grooves 804 are conveniently constructed with radial sides 805 and a circular arc bottom 806 concentric with axis 803.

Figure 10:
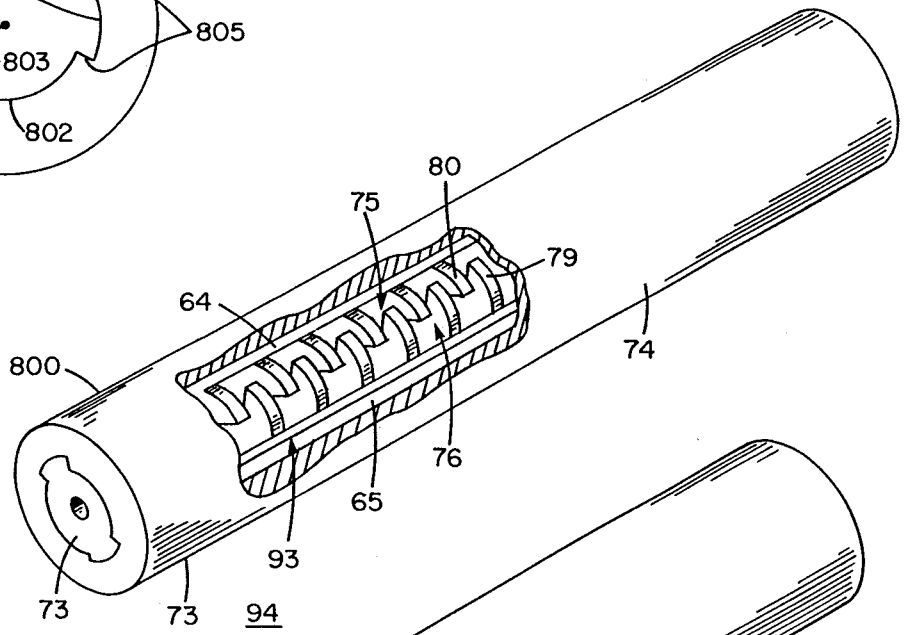
FIG. 10 is an isometric view in partial section of the delay line assembly.

The semi-cylinder portions 75, 76 of FIG. 8 are assembled using the tapered pins 88 to accurately align portions 75, 76 to form an interdigital arrangement of disks 79, 80 as shown in FIG. 10. Prior to assembly, the shims 89, 90 are inserted between ends 73, 74, respectively, with the holes 91, 92 of the shims in alignment with the tapered alignment holes 77, 78, respectively, in order that the assembly of semi-cylindrical portions 75, 76 will form a cylindrical exterior surface except for the rail portions 64, 65. As stated earlier, the thickness of the shims 89, 90 is of the same thickness as the material eroded during the process of longitudinally splitting ends 73, 74.

The disk assembly 93 of the portions 75, 76, shims 89, 90, and pins 88 is inserted into the cylindrical hole 801 formed in the shell 800 as shown in FIG. 10 to form slow-wave structure 94. The hole 801 is sufficiently larger than the assembly 93 to provide clearance, typically 0.001 inch. The slow-wave structure 94 of FIG. 10 is then inserted into a cylindrical hole in a mandrel (not shown) of slightly larger diameter than that of the shell 800 and of substantially the same length. The material of the mandrel has preferably a substantially lower thermal temperature expansion coefficient than the delay line and shell. The temperature of the structure 94 and the mandrel is raised to a point where the common surfaces of the delay line and the shell are compressed and the gold plating 59 diffuses into both surfaces which causes the assembly 93 and shell 800 to be brazed to form the structure 94 of FIG. 10 when cooled below the gold-copper diffusion. The mandrel surrounding the structure 94 constrains the thermal expansion of the structure 94 during the brazing process so that when cooled to room temperature, strains are not imposed on the structure 94.

Figure 11:
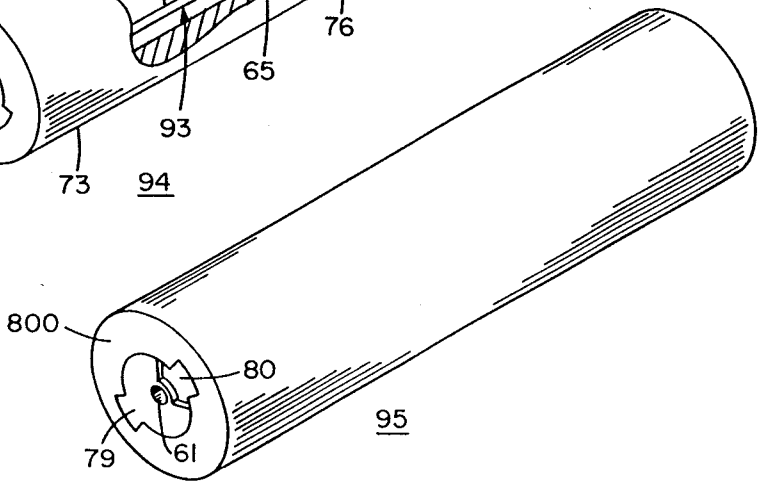
FIG. 11 is an isometric view of one embodiment of the completed slow-wave structure of the invention.

The final step in the fabrication of the delay line of this invention is the removal of the ends 73, 74 of structure 94 and their overlapping portions of the shell 800 leaving a delay line 95 shown in the isometric view of FIG. 11 in which disks 79, 80 are enveloped by the shell 800. The alternate slot-coupled cavity delay line 95 has a beam tunnel or hole 61 in which the disks 79, 80 form a so-called mono-constructed delay line 95 because the disks 79, 80 forming the delay line 95 were fabricated from a common cylinder 60 of copper. The delay line 95 can be for conventional delay lines which form a part of a traveling wave tube 1 to provide improved electrical performance at reduced fabrication cost.

Figure 12:
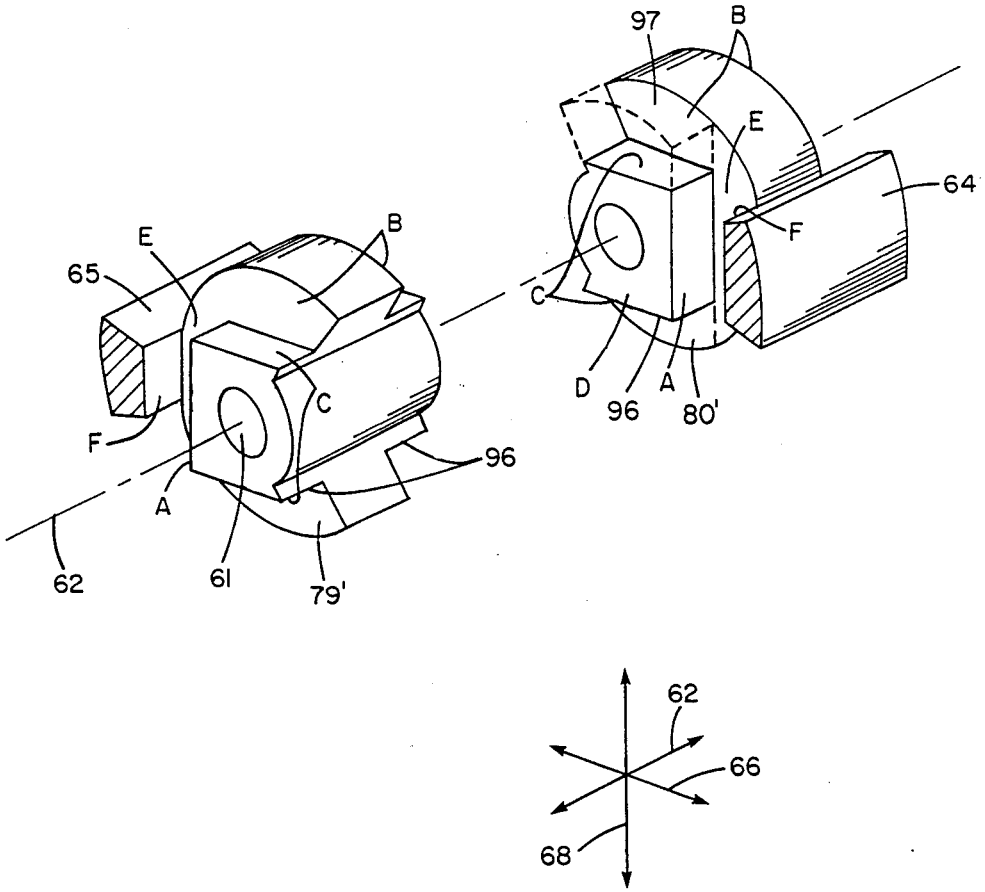
FIG. 12 is an isometric view of a preferred embodiment showing the ridged disks of a slow-wave structure.

The slow-wave structure of FIG. 11 is preferably modified to include ridges 96 surrounding the beam tunnel 61 on each side of the disks 79, 80 in order to increase the coupling between an electron beam and the delay line when the beam traverses the interaction gap formed between adjacent disks (for example the disks 79, 80). The modified form of disks 79', 80' is shown in FIG. 12 with the axially and radially extending ridges 96 forming part of the disks 79', 80'. Only two disks 79', 80' are shown in FIG. 12, but it should be understood that they form only illustrative disks of a plurality of disks such as shown in FIG. 8. These ridges are often referred to as ferrules by those skilled in the art. In order to form disks 79', 80', the wire used in the electric discharge machining is initially parallel to axis 68 which is transverse to the plane formed by axes 66, 62 of FIGS. 2 and 12. As previously described, the wire direction 68 was used to produce cuts along line 69 when producing planar disks 79, 80. The surfaces A, D, E, and F of FIG. 12 may be formed as part of ridge-modified disks 79', 80' by movement of the cutting wire, when oriented along the direction of axis 68, in a succession of incremental distances along a modified path 69 of FIG. 2 in the directions of successive alternate axes 62, 66. Such motion of the cutting wire will form ridges 96 of both disks 79', 80' including portion 97 which is to be removed in a subsequent machining operation (only one portion 97 is shown for clarity). Following this cutting operation, the bar 63 of FIG. 3 is split and EDM machined to provide disks similar to that shown in FIGS. 6 and 7 except with ridge-modified disks 79', 80' on which further cuts are to be made to form the surfaces B and C thereby forming the completed ridges 96. (Alternatively, surfaces B and C may be formed before bar 63 is split.) Orientation of the EDM wire in the direction of axis 66 and successive movement of the wire in the direction of axes 62, 68 will remove the material of portion 97 shown in dashed lines in FIG. 12. The resulting ridged disks 79', 80 with their ridges 96 are shown in isometric view in FIG. 12. It is apparent that the rails 64, 65 will not extend beyond the surfaces C of each ridge 96 in order not to interfere with the cutting wire during the cutting operation.

Having described a preferred embodiment of the invention, it will be apparent to one of skill in the art that other embodiments incorporating its concept may be used. It is felt, therefore, that this invention should not be limited to the disclosed embodiment but rather should be limited only by the spirit and scope of the appended claims.

What is claimed is:

1. A method of making a slow-wave circuit comprising:

forming a cylinder having an axis of symmetry of a first diameter from a bar of metal with axially diametrically opposed rails extending radially;

first wire electric discharge machining with said first wire parallel to said axis providing a longitudinally extending hole through said bar centered on said axis;

second wire electric discharge machining of said bar with said second wire in a transverse direction relative to said bar to form a first plurality of axially distributed electric circuits attached to said rails which in combination form said slow-wave circuit;

said first and second machining of said electric circuits being performed while said bar is one integral body;

inserting said machined bar into a cylindrical shell of greater internal diameter than said first diameter; and brazing said inserted bar to said shell to form said slow-wave circuit.

2. The method of claim 1 wherein said method comprises in addition:

longitudinally splitting said bar to form semi-cylindrical split bars having symmetry with respect to said axis after said first and second electric discharge machining to provide said split bars each supporting a second plurality of said electric circuits attached to one of said rails;

third wire electric discharge machining of said split bars with said wire parallel to said axis to perform further machining of said second electric circuits attached to said rail;

said wire direction during said second machining being parallel to the axis of said split bar;

reassembling said split bars to form an assembled cylindrical bar;

said inserting of said machined bar being in the form of an assembled cylindrical bar into a cylindrical shell; and said brazing of said inserted bar being in the form of said assembled cylindrical bar brazed to said shell to form said slow-wave circuit.

3. The method of claim 2 wherein said longitudinal splitting is produced by wire electric discharge machining.

4. The method of claim 1 wherein said metal is oxygen-free high-electrical-conductivity copper.

5. A method of making a slow-wave circuit comprising:

machining a bar of electrically conductive material to form a cylinder with an axis of symmetry having longitudinal rails extending radially from the surface of said cylinder;

said rails being located diagonally opposite each other;

electric discharge machining to produce cuts through said bar by a wire in a direction transverse to a plane through said axis and said rails;

said machining being along the axial direction at each end of said cylinder; and said machining producing an interdigitated structure having radially inwardly extending discs which are transverse to said axis.

6. The method of claim 5 further comprising machining said bar to provide an axially extending hole centered on said axis through said bar thereby forming an electron beam tunnel.

7. The method of claim 6 further comprising:

said machining producing two semi-cylinders symmetrical about said axis;

each said semi-cylinders having longitudinally spaced discs each having a flat surface opposite an area of attachment of said disc to said rail portion of said semi-cylinder; and machining said flat surface to provide a cylindrical surface concentric with said axis and outwardly radially spaced from a wall of said beam tunnel and substantially flat radially-directed surfaces from each of said flat surface to said concentric surface.

8. The method of claim 7 wherein said machining producing an interdigitated structure having inwardly extending disks includes moving said wire along said axis direction to form a pair of surfaces spaced from said axis and extending axially from a surface of each said disk to form a partially complete ridged disk.

9. The method of claim 8 comprising in addition:

further electric discharge machining of said partially complete ridged disk by a wire oriented transverse to said axis of symmetry.

10. The method of claim 9 wherein said wire oriented transverse to said axis of symmetry is also in a plane parallel to said axis of symmetry and a center line through said rails.

11. A slow-wave circuit comprising:

a first plurality of electric circuits distributed in a longitudinal direction;

at least one support rail extending in said longitudinal direction;

each said at least one support rail and a different second plurality of said electric circuits being from a same block of electrically conductive material so that said second plurality of electric circuits are supported by said at least one support rail without any intermediate supporting material;

a cylindrical shell having a longitudinally extending inner diameter; and said support rods and their associated electric circuits assembled to form a cylinder electrically and mechanically attached to said inner diameter of said shell thereby forming said slow-wave circuit.

12. A slow-wave circuit comprising:

a cylindrical shell of electrically conductive material having a circular axially extending inner periphery;

a first and second rail supporting a first and second plurality of disks of said electrically conductive material, respectively;

each rail and supported plurality of disks being formed from one block of material;

said first and second rails and supported disks assembled to form an interdigitated assembly of spaced said disks;

said interdigitated assembly of said disks having a circular outer periphery; and said outer periphery having a mechanical and electrical bond to the circular inner periphery of said shell.

13. The slow-wave circuit of claim 12 wherein said mechanical and electrical bond comprise a metal braze.

14. The slow-wave circuit of claim 13 wherein said metal braze is a gold braze.

15. The slow-wave circuit of claim 12 wherein said electrically conductive material is oxygen-free, high-electrical-conductivity copper.

16. A slow-wave circuit comprising:

a first and second rail each extending in a longitudinal direction;

each rail having a plurality of longitudinally spaced disks;

each disk extending transversely in the same direction from the rail and each disk lying in a plane transverse to said longitudinal direction;

each said rail and its disks being formed of a common material without being otherwise bonded to each other;

each disk of said disks of each rail having a circular periphery lying in a cylindrical surface;

a shell having an internal cylindrical surface of the same diameter as the diameter of said disks;

said shell having longitudinally extending grooves adapted to receive said rails; and said rails and disks being electrically and mechanically bonded to said shell by a braze in a manner such that said disks of said rails are interdigitated and thereby form a slow-wave structure.

17. The slow-wave structure of claim 16 wherein:

said shell has an axis of symmetry;

each said disk extends radially from one side of said shell internal surface to beyond said axis of symmetry but short of the diametrically opposite side of said shell internal surface; and each said disk having a circular aperture centered on said axis of symmetry.

18. The slow-wave structure of claim 17 wherein each said disk has that portion beyond said axis of symmetry terminate in radial edges between said circular aperture and said internal surface of said shell.

19. The slow-wave structure of claim 17 wherein:

said disks have an axially extending ridge on each side of said disk;

each said ridge having a ridge aperture coincident with said disk aperture; and said ridge having a periphery surface which is spaced radially from said axis by a distance greater than said ridge aperture.

20. The slow-wave structure of claim 19 wherein said ridge has a plurality of flat surfaces forming said ridge peripheral surfaces.

* * * * *